US008726985B2

(12) United States Patent
Hessels et al.

(10) Patent No.: US 8,726,985 B2
(45) Date of Patent: May 20, 2014

(54) EXPANDING A TUBULAR ELEMENT IN A WELLBORE

(75) Inventors: Johannes Louis Leonardus Hessels, Eindhoven (NL); Serge Mathieu Roggeband, Assen (NL); Antonius Leonardus Maria Wubben, Rijswijk (NL); Djurre Hans Zijsling, Rijswijk (NL)

(73) Assignee: Enventure Global Technology, LLC, Houston, TX (US)

( * ) Notice: Subject to any disclaimer, the term of this patent is extended or adjusted under 35 U.S.C. 154(b) by 382 days.

(21) Appl. No.: 13/141,709

(22) PCT Filed: Dec. 22, 2009

(86) PCT No.: PCT/EP2009/067732

§ 371 (c)(1),
(2), (4) Date: Jun. 23, 2011

(87) PCT Pub. No.: WO2010/072751

PCT Pub. Date: Jul. 1, 2010

(65) Prior Publication Data

US 2011/0259609 A1 Oct. 27, 2011

(30) Foreign Application Priority Data

Dec. 24, 2008 (EP) ..... 08172920

(51) Int. Cl.
*E21B 23/00* (2006.01)

(52) U.S. Cl.
USPC ..... 166/212; 166/384; 166/216; 166/207

(58) Field of Classification Search
USPC ..... 166/212, 207, 380, 384, 216, 206, 227
See application file for complete search history.

(56) References Cited

U.S. PATENT DOCUMENTS 7,048,065 B2 * 5/2006 Badrak et al. ..... 166/382
7,222,669 B2 * 5/2007 Sonnier et al. ..... 166/206

(Continued)

FOREIGN PATENT DOCUMENTS

EP 1618280 6/1985 ..... E03F 3/06
EP 1438483 7/2004

(Continued)

OTHER PUBLICATIONS

Search Report dated Jan. 11, 2011 for corresponding International Application No. PCT/EP2009/067732 (6 pgs.).

(Continued)

*Primary Examiner* — Kenneth L Thompson
(74) *Attorney, Agent, or Firm* — Derek V. Forinash; Porter Hedges LLP

(57) ABSTRACT

A method is provided of radially expanding a tubular element (56) in a well-bore using an expander located in the tubular element, the expander (40) comprising an expansion member (48) and a plurality of segments (50) spaced in circumferential direction around the expansion member, the segments being movable between a radially retracted position and a radially expanded position by axial movement of the expansion member relative to the segments. The method includes a plurality of successive expansion cycles, wherein each expansion cycle comprises the steps of: (a) moving the expander (40) in axially forward direction through the tubular element (56) whereby the segments (56) are in the radially retracted position; and (b) radially expanding the tubular element by moving the segments to the radially expanded position by axially moving the expansion member relative to the segments.

22 Claims, 4 Drawing Sheets

(56) References Cited

U.S. PATENT DOCUMENTS

| | | | | |
|---|---|---|---|---|
| 7,726,395 | B2 * | 6/2010 | McHardy et al. | 166/207 |
| 7,730,955 | B2 * | 6/2010 | Farquhar et al. | 166/380 |
| 8,020,625 | B2 * | 9/2011 | Ring et al. | 166/380 |
| 8,069,916 | B2 * | 12/2011 | Giroux et al. | 166/212 |
| 2003/0111234 | A1 | 6/2003 | McClurkin et al. | 166/384 |
| 2004/0168796 | A1 | 9/2004 | Baugh et al. | 166/206 |
| 2004/0216891 | A1 * | 11/2004 | Maguire | 166/380 |
| 2007/0012443 | A1 | 1/2007 | Luke et al. | 166/277 |

FOREIGN PATENT DOCUMENTS

| | | | |
|---|---|---|---|
| EP | 0146331 | 4/2007 | E21B 43/10 |
| GB | 2367842 | 4/2002 | E21B 29/00 |
| GB | 2392933 | 3/2004 | E21B 43/10 |
| GB | 2402952 | 12/2004 | E21B 43/10 |
| WO | WO03036025 | 5/2003 | E21B 43/10 |
| WO | WO2004005669 | 1/2004 | E21B 43/10 |
| WO | WO2007090338 | 8/2007 | E21B 29/10 |
| WO | 2010072751 | 7/2010 | |

OTHER PUBLICATIONS

International Report of Patentability and Written Opinion dated Jun. 29, 2011 for corresponding International Application No. PCT/EP2009/067732 (5 pgs.).

* cited by examiner

EXPANDING A TUBULAR ELEMENT IN A WELLBORE

CROSS REFERENCE TO EARLIER APPLICATIONS

The present application is a national stage application of International application No. PCT/EP2009/067732, filed 22 Dec. 2009, which claims priority of EP08172920.4 filed in the European patent office on 24 Dec. 2008 and incorporated herein by reference.

FIELD OF THE INVENTION

The present invention relates to a method of radially expanding a tubular element in a wellbore using an expander located in the tubular element.

BACKGROUND OF THE INVENTION

Expansion of tubular elements, such as casings or liners, in wellbores is increasingly applied in the industry of oil and gas production from earth formations, whereby one or more boreholes are drilled to produce hydrocarbon fluid from a subterranean reservoir zone to a production facility at surface. Conventionally such borehole is provided with several casings at different depth levels during drilling of the borehole. Each subsequent casing must pass through a previously installed casing, therefore the casings are of decreasing diameter in downward direction, which results in a nested arrangement of the casings. Thus, the available wellbore diameter for the production of hydrocarbon fluid decreases with depth. This can lead to technical and/or economical drawbacks, especially for deep wells with a relatively large number of casings.

To overcome such drawbacks it has already been proposed to use a casing scheme whereby individual casings are radially expanded after installation in the wellbore. Such casing scheme leads to less reduction of the available wellbore diameter with depth. Generally, such tubular element is radially expanded by pulling, pumping or pushing a conical expander through the tubular element after lowering of the tubular element into the wellbore. However the expansion forces necessary for moving the expander through the tubular element are sometimes extremely high since such force not only has to expand the tubular element, but also has to overcome the friction between the expander cone and the tubular element.

EP 1618280 B1 discloses a method of radially expanding a tubular element in a wellbore using an expander located in the tubular element, the expander comprising a plurality of segments spaced in circumferential direction around a bladder having a fluid chamber. The tubular element is expanded in a plurality of cycles whereby in each cycle the segments move from a radially retracted position to a radially expanded position by pumping fluid into the fluid chamber so that the bladder inflates and the expander performs an expansion stroke.

In some applications it has been experienced that the segments may not always expand uniformly and that the bladder becomes damaged after repeated expansion cycles.

US-2003/0111234-A1 discloses a system for expanding for expanding a tubular liner. The system includes an expansion device comprising a mandrel with multiple segments moved between a contracted state and an expanded state. When in the expanded state, the mandrel is pushed or pulled through the tubular liner to expand the liner.

WO-03/036025-A1 discloses a system for lining a wellbore with an expandable tubular element. The system comprises an expansion cone which is arranged at a lower end of a string extending into the wellbore, and anchoring means for anchoring an upper end part of the tubular element in the wellbore. Once the tubular element is anchored, the expansion cone is pulled through the tubular element to expand the element.

The above systems comprise an expander which is pulled or pushed through the tubular element. Hence, these systems expand the tubular element to the diameter of the expander cone and lack the possibility to accommodate to local variations of the wellbore diameter.

SUMMARY OF THE INVENTION

It is an object of the invention to provide an improved method of radially expanding a tubular element against a wall in a wellbore, which overcomes the drawbacks of the known method.

In accordance with the invention there is provided a method of radially expanding a tubular element in a wellbore using an expander located in the tubular element, the expander comprising an expansion member and a plurality of segments spaced in circumferential direction around the expansion member, the segments being movable between a radially retracted position and a radially expanded position by axial movement of the expansion member relative to the segments, the method including a plurality of expansion cycles, wherein each expansion cycle comprises the steps of:

(a) moving the expander in axially forward direction through the tubular element whereby the segments are in the radially retracted position; and (b) expanding the tubular element by moving the segments to the radially expanded position by axially moving the expansion member relative to the segments.

Thus, there is no longer a need for a bladder to expand the segments. Further, by axially moving the expansion member relative to the segments it is ensured that the segments expand uniformly. In addition, due to the successive expansion cycles, the expansion method of the invention can accommodate to local variations of the wellbore diameter.

Suitably each segment and the expansion member have a wedge-shaped common contact surface so as to induce radially outward movement of the segment upon movement of the expansion member relative to the segment in a first axial direction, and to induce radially inward movement of the segment upon movement of the expansion member relative to the segment in a second axial direction opposite to the first axial direction.

Movement of the segments from the retracted position to the expanded position defines an expansion stroke. In order to expand the tubular element in a compliant mode, whereby the tubular element is expanded such that its shape after expansion complies with the shape of a boundary wall surrounding the tubular element, or such that wall thickness variations of the tubular element are taken into account, the method preferably comprises a plurality of successive expansion cycles whereby the magnitude of the respective expansion strokes is varied.

For example, the tubular element is radially expanded against a wall in the wellbore of varying diameter, and the magnitude of the respective expansion strokes is varied in correspondence with said varying diameter of the wall. The axial movement of the expansion actuator defines an actuator stroke, and it is preferred that the magnitude of the expansion strokes of the segments is varied by varying the magnitude of the actuator strokes of the expansion member.

In a preferred embodiment the tubular element is expanded in separate expansion stages, wherein the segments comprise first and second sets of segments. The second set of segments is arranged in a following position relative to the first set of segments, whereby in the radially expanded position the second set of segments is of larger diameter than the first set of segments. In step (b) the tubular element is expanded to a first diameter by the first set of segments and to a second diameter by the second set of segments, the second diameter being larger than the first diameter.

Suitably the expander comprises a hydraulic actuator operable to induce said axial movement of the expansion member.

It is preferred that the hydraulic actuator is in fluid communication with a hydraulic fluid supply conduit, and the expander is suspended in the wellbore on the hydraulic fluid supply conduit. The hydraulic fluid supply conduit is, for example, a drill pipe or a coiled tubing.

The expansion member is suitably subjected to alternating axial movement so as to alternatingly move the segments between the radially retracted position and the radially expanded position, wherein the hydraulic actuator comprises a valve system operated to induce said alternating movement of the expansion member.

BRIEF DESCRIPTION OF THE DRAWINGS

The invention will be described hereinafter in more detail and by way of example, with reference to the accompanying drawings in which.

In the Figures, like reference numerals relate to like components.

DETAILED DESCRIPTION OF THE INVENTION

Figure 1:
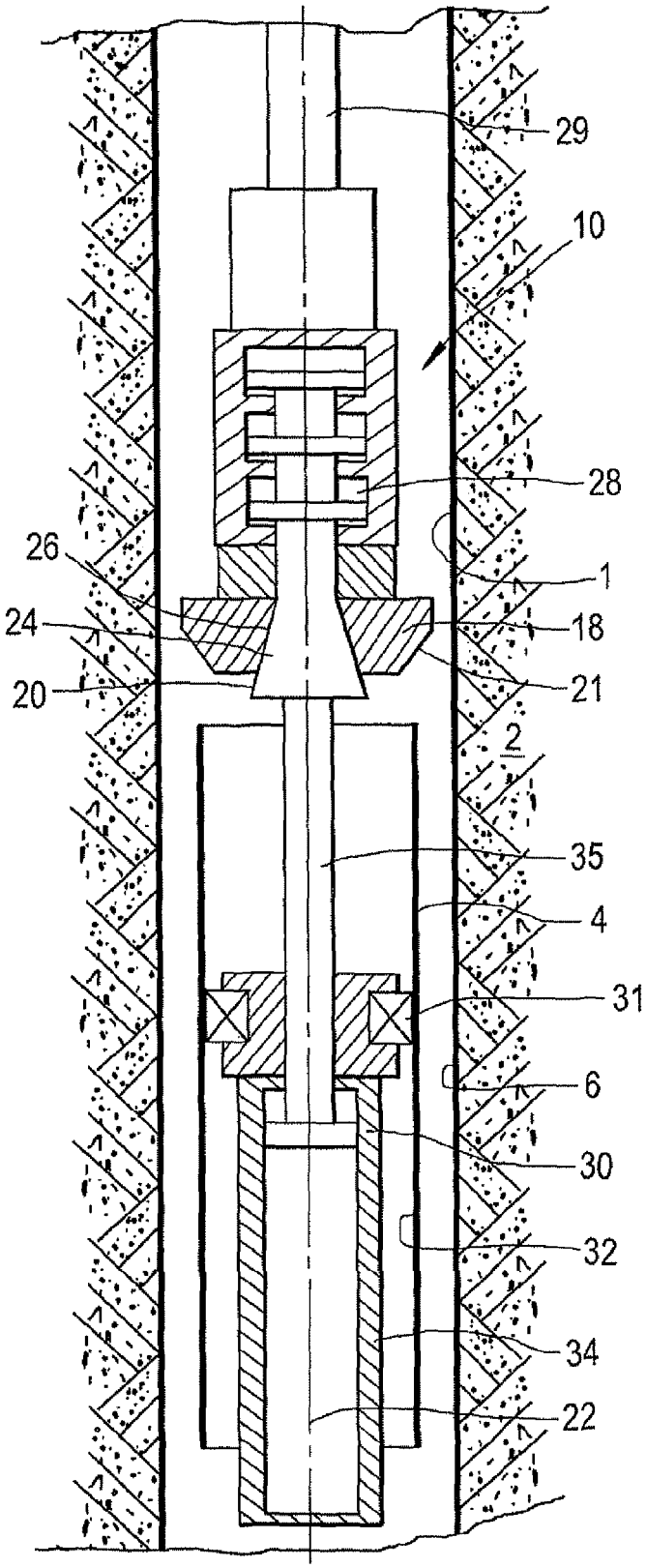
FIG. 1 schematically shows an embodiment of an expander for use in the method of the invention, in longitudinal section.

Referring to FIG. 1 there is shown a wellbore 1 formed in an earth formation 2, wherein an expandable tubular element 4 is located in the wellbore 1 prior to being radially expanded against the wall 6 of the wellbore. An expander 10 extends into the wellbore, the expander comprising a set of segments 18 circumferentially spaced around an expansion member 20. Dotted line 22 represents a central longitudinal axis of the system shown. The segments are radially movable relative to the central longitudinal axis 22, and the expansion member 20 is axially movable relative to the segments 18. The expansion member 20 has an upwardly tapering outer surface 24, and each segment 18 has an inner surface 26 in contact with the tapering outer surface 24 of the expansion member, wherein the surfaces 24, 26 are substantially complementary in shape. By virtue of this configuration, the segments 18 move radially outward when the expansion member 20 is moved axially upward, and the segments 18 move radially inward when the expansion member 20 is moved axially downward. The expander 10 is movable between a radially expanded mode whereby the segments 18 are in the radially outermost position and a radially retracted mode whereby the segments 18 are in the radially innermost position. In the radially retracted mode, a lower portion of the set of segments 18 fits inside the unexpanded tubular element 4 while an upper portion of the set of segments 18 is of larger diameter than the inner diameter of the unexpanded tubular element 4. Further, in the radially expanded mode, the expander expands the tubular element 4 against the wellbore wall 6.

The expansion member 20 is connected to a hydraulic actuator 28 operable to move the expansion member 20 axially upward or downward relative to the segments 18. Hydraulic fluid is supplied to the hydraulic actuator 28 via a string of coiled tubing 29 extending from surface to the expander 10. Instead of a string of coiled tubing any other suitable string can be used, for example a string of jointed drill pipe.

The expander 10 further comprises an anchoring device 30 including an anchor 31 movable between a radially retracted position in which the anchor 31 is free from the inner surface 32 of the tubular element 4 and a radially expanded position in which the anchor 31 is fixedly connected to the inner surface 32. The anchoring device 30 also includes a hydraulic suspension actuator 34 connected to the expansion member by shaft 35 and operable to move the anchor 31 in axial direction relative to the expansion member 20. The suspension actuator 34 is controlled from surface by hydraulic fluid supplied via the string of coiled tubing 29.

Figure 2:
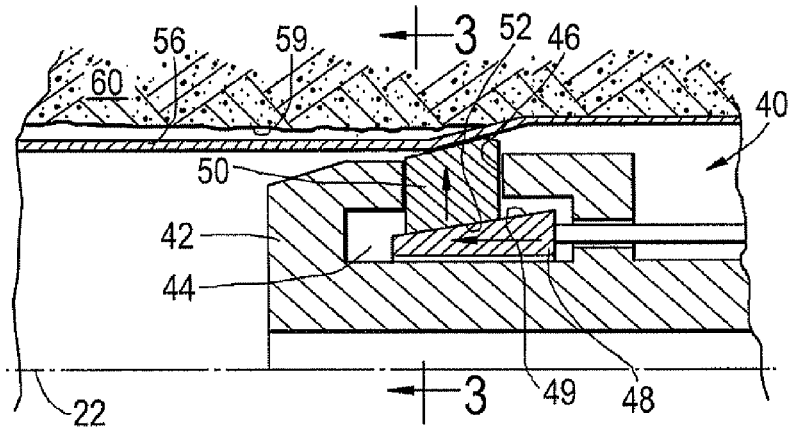
FIG. 2 schematically shows an alternative expander for use in the method of the invention, in longitudinal section.
Figure 4:
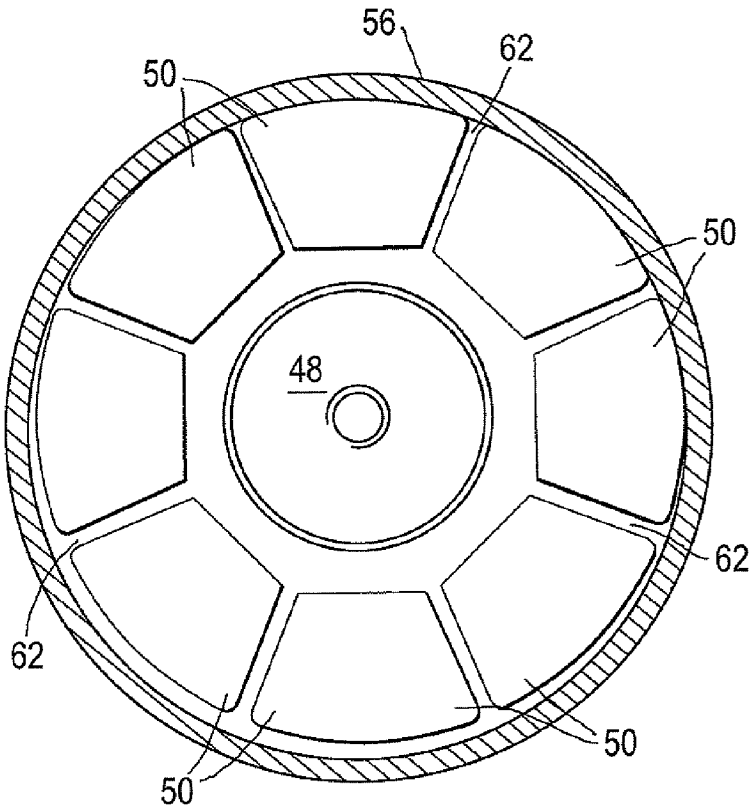
FIG. 4 shows cross-section 3-3 of FIG. 2, with the expander in a radially expanded position.
Figure 3:
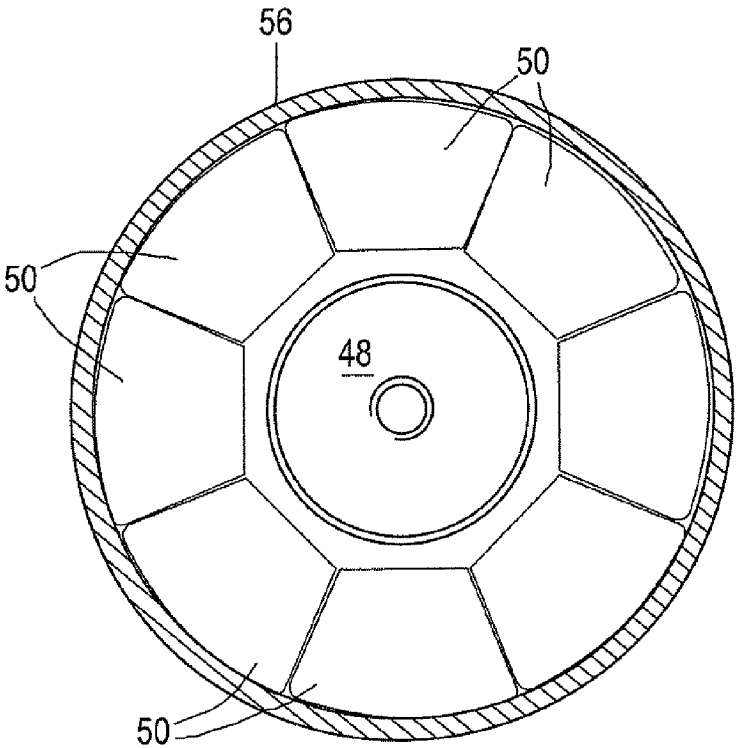
FIG. 3 shows cross-section 3-3 of FIG. 2, with the expander in a radially retracted position.

Referring to FIGS. 2-4 there is shown an alternative expander 40 for use in the method of the invention. The expander 40 comprises a cylindrical housing 42 having an annular chamber 44 and an annular slot 46 extending from the chamber 44 to the outer surface of the expander 40. An annular expansion member 48 having a tapering outer surface 49 is positioned in the chamber 44 in a manner that the expansion member 48 is axially movable in the chamber 44. Further, the expander comprises a plurality of segments 50 spaced in circumferential direction around the expansion member 48 whereby the segments 50 pass through the annular slot 46 and are movable between a radially retracted position and a radially expanded position. Each segment 50 has a tapering inner surface 52 in contact with the tapering outer surface 49 of the expansion member 48 such that the segment 50 moves radially outward upon axial movement of the expansion member 48 in the direction of arrow 54. Conversely, segment 50 moves radially inward upon axial movement of the expansion member 48 in the direction opposite to arrow 54. The expander 40 is positioned in an expandable tubular element 56 extending into a wellbore 59 formed in an earth formation 60.

In FIGS. 3 and 4 is shown a cross-sectional view of the expander 40, whereby in FIG. 3 the segments 50 are in the radially retracted position, and in FIG. 4 the segments 50 are in the radially expanded position with small gaps 62 present between adjacent segments 50.

Figure 5:
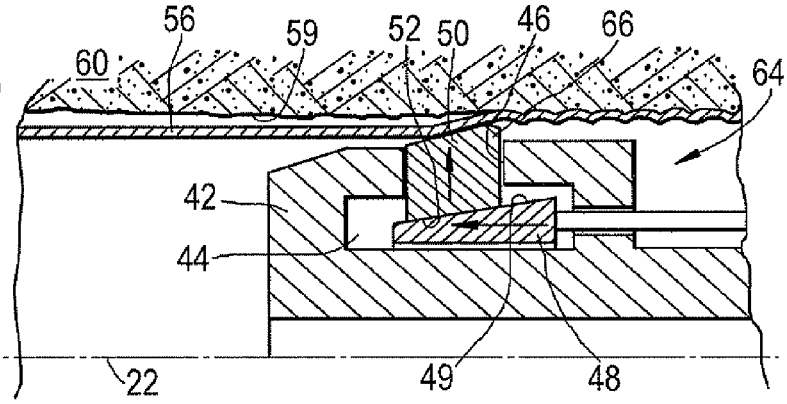
FIG. 5 schematically shows a modified version of the expander of FIG. 2.

Referring further to FIG. 5 there is shown a modified expander 64, which is substantially similar to the expander 40 except that the segments 50 have a curved outer surface 66 so as to create a corrugated profile in the tubular element 56 upon expansion with expander 64.

Figure 6:
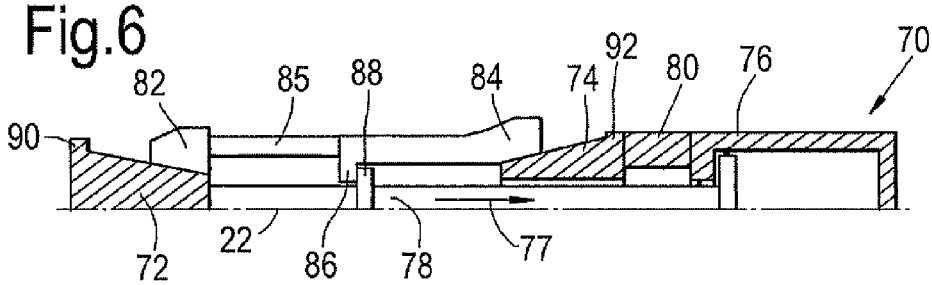
FIG. 6 schematically shows, in longitudinal section, another alternative expander for use in the method of the invention, in a radially retracted position.
Figure 7:
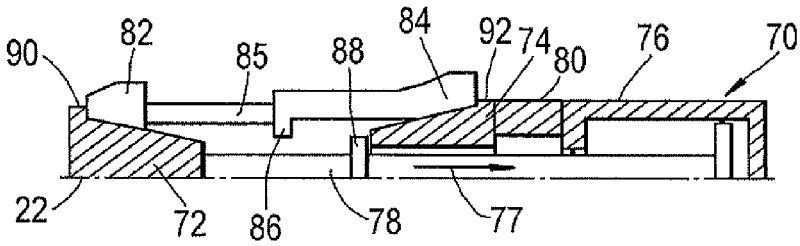
FIG. 7 shows the expander of FIG. 6 when in a radially expanded position.

Referring further to FIGS. 6 and 7, there is shown another alternative expander 70 for use in the method of the invention. The expander 70 comprises a first expansion member in the form of wedge 72 and a second expansion member in the form of wedge 74, the wedges 72, 74 tapering towards each other. A hydraulic actuator 76 is arranged to pull wedge 72 in the direction of arrow 77 by means of a pulling rod 78 connected to a piston 77 of the hydraulic actuator. Wedge 74 is in abutment with housing 80 of the hydraulic actuator 76. A first set of segments 82 is circumferentially spaced around wedge 72 and in contact with its tapering surface, and a second set of segments 84 is circumferentially spaced around wedge 74 and in contact with its tapering surface. The segments 82, 84 are radially movable between a retracted position and expanded position, and a spacer cylinder 85 interconnects the first and second sets of segments 82, 84. The segments 84 extend further radially outward than the segments 82 so that, when the segments 82, 84 are in the radially expanded position, the second set of segments 84 has a larger outer diameter than the first set of segments 82. The second set of segments 84 is provided with a dog 86 abutting against a ring 88 connected to the pulling rod 78 so as to limit axial movement of the second set of segments 84 during an expansion stroke of the expander. Further, the wedges 72, 74 are provided at their large diameter end with respective end stops 90, 92.

Figure 8:
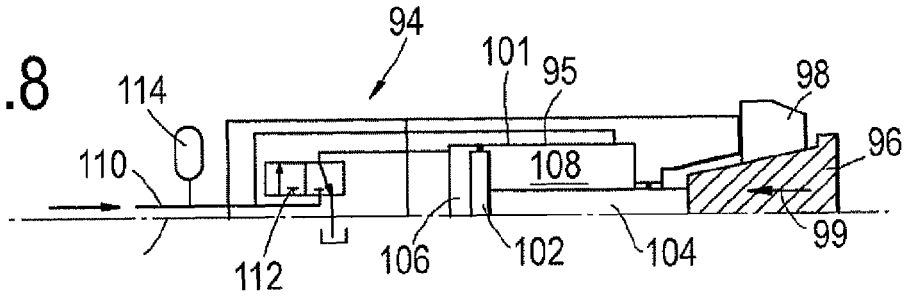
FIG. 8 schematically shows a hydraulic control system for use in the method of the invention, in a first mode of operation.
Figure 9:
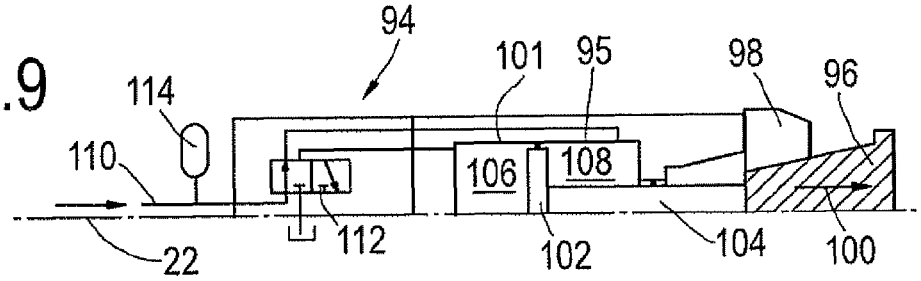
FIG. 9 shows the hydraulic control system of FIG. 8 when in a second mode of operation.

Referring to FIGS. 8, 9 there is shown an expander and a hydraulic control system 94 for controlling a hydraulic actuator 95 of the expander. The expander comprises a wedge 96 and a set of segments 98 circumferentially spaced around the wedge 96 and in contact with its tapering surface. The segments 98 move to a radially expanded position upon movement of wedge 96 in the direction of arrow 99, and to a radially retracted position upon movement of wedge 96 in the direction of arrow 100. The hydraulic actuator 95 comprises a piston/cylinder assembly 101 having a piston 102 that is connected to the wedge 96 by a pulling rod 104. The piston/cylinder assembly 101 has respective fluid chambers 106, 108 at opposite sides of the piston 102 whereby fluid chamber 108 is located at the side of the pulling rod 102. Further, in view of the presence of the pulling rod 102 in chamber 108, the piston 102 has a smaller hydraulic area at the side of chamber 108 than at the side of chamber 106.

The hydraulic control system 94 comprises a fluid supply line 110 providing fluid communication between fluid chamber 108 and a pump at surface (not shown). A three-way valve 112 is arranged to provide, in a first mode of operation, fluid communication between the fluid chamber 106 and the wellbore interior. In a second mode of operation, the three-way valve 112 provides fluid communication between fluid chamber 106 and fluid supply line 110. A fluid accumulator 114 is provided to absorb pressure peaks in the fluid supply line 110.

Figure 10:
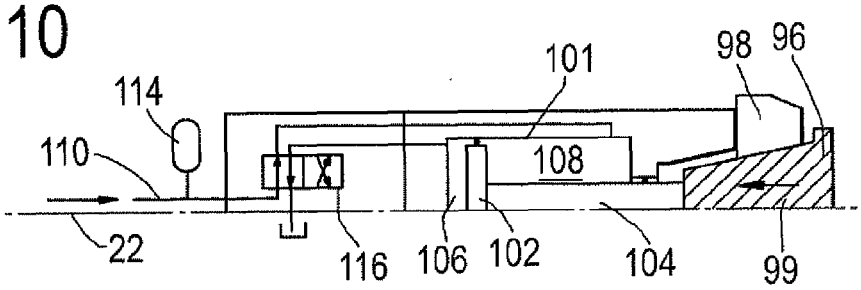
FIG. 10 schematically shows an alternative hydraulic control system for use in the method of the invention, in a first mode of operation.
Figure 11:
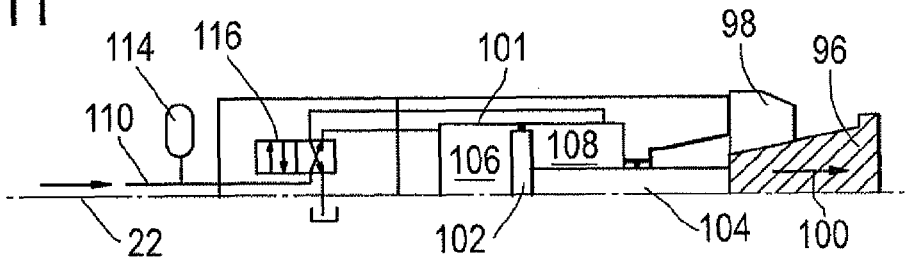
FIG. 11 shows the hydraulic control system of FIG. 10 when in a second mode of operation.

Referring to FIGS. 10, 11 there is shown an alternative hydraulic control system 116 substantially similar to the control system 94, except that a four-way valve 116 is used instead of a three-way valve. In a first mode of operation, the four-way valve 116 provides fluid communication between the fluid supply line 110 and fluid chamber 108 while also providing fluid communication between fluid chamber 106 and the ambient. In a second mode of operation, the four-way valve 116 provides fluid communication between the fluid supply line 110 and fluid chamber 106 while also providing fluid communication between fluid chamber 108 and the ambient.

During normal use of the system of FIG. 1, in a first step the anchoring device 30 is positioned inside the tubular element 4 with the anchor 31 in the radially retracted position and the expander 10 located above the tubular element 4. The anchor 31 is then induced to move to the radially expanded position so as to be fixedly connected to the tubular element 4. The expansion assembly 8 with the tubular element 4 suspended thereto is then lowered into the wellbore 1 on the coiled tubing string 29.

In a second step, with the expander in the radially retracted mode, the suspension actuator 34 is hydraulically controlled from surface to move the anchor 31 with the tubular element 4 connected thereto axially upward until the segments 18 become partially located in the tubular element 4 and the tubular element 4 stops against the segments 18 of the expander. Then the suspension actuator 34 is controlled so that the tubular element 4 remains pressed against the segments 18.

In a third step the multistage piston/cylinder assembly 28 is controlled to move the expansion actuator 20 axially upward and thereby to move the segments 18 radially outward while the tubular element 4 remains pressed against the segments 18 by suspension actuator 34. As a result, an upper portion of the tubular element 4 is radially expanded against the wellbore wall 6. In a fourth step the piston/cylinder assembly 28 is controlled to move the expansion actuator 20 axially downward so that the segments 18 radially retract. With the segments 18 radially retracted, the expander 10 is moved axially downward until the segments 18 stop against the inner surface of the unexpanded portion of the tubular element 4. Such axial downward movement of the expander 10 occurs by gravity and, if necessary, by operation of the suspension actuator 34 to pull the expander 10 downward.

The third and fourth steps are repeated a sufficient number of times until the tubular element becomes fixedly connected to the wellbore wall 6 so that the anchoring device is no longer necessary to suspend the tubular element 4.

In a fifth step, the anchor 31 is radially retracted from the inner surface 32 of the tubular element 4. Thereafter, the third and fourth steps are repeated until the entire tubular element 4 has been radially expanded against the wellbore wall 6. To retrieve the expansion assembly 8, the expander 10 is brought to the radially retracted mode, and the expansion assembly 8 is retrieved through the expanded tubular element 4 to surface.

Normal use of the system of FIGS. 2-4 is substantially similar to normal use of the system of FIG. 1, albeit that the expansion member 48 is pushed rather than pulled during the expansion stroke to move the segments 50 from the radially retracted position to the radially expanded position. The segments 50 move radially outward when the expansion member 48 moves in direction 54, and radially inward when the expansion member 48 moves in the opposite direction.

Normal use of the system of FIG. 5 is substantially similar to normal use of the system of FIGS. 2-4. Here the curved outer surface 66 of the set of segments 50 creates a corrugated profile in the tubular element 56 so as to increase the collapse strength of the tubular element 56.

Normal use of the system shown in FIGS. 6, 7 is substantially similar to normal use of the system of FIG. 1. In each expansion cycle, the hydraulic actuator 76 is operated to pull pulling rod 78 in the direction of arrow 77 whereby the tapering surface of wedge 72 moves the segments 82 to the radially expanded position, and the tapering surface of wedge 74 moves the segments 84 to the radially expanded position. As a result, the segments 82 expand the tubular element to a first diameter, and the segments 82 expand the tubular element from the first diameter to a second diameter larger than the first diameter. After the expansion stroke, the hydraulic actuator 76 is operated to move pulling rod 78 in the opposite direction whereupon the segments 82, 84 radially retract. The expander 70 is then moved in forward direction through the tubular element to perform a next expansion cycle. It should be noted that forward direction is the direction opposite to arrow 77.

During normal operation of the hydraulic control system 94 of FIGS. 8, 9, the pump at surface is operated to pump pressurised fluid into fluid supply line 110. To perform an expansion stroke, the three-way valve 112 is set to the first mode of operation whereby the fluid chamber 106 is in fluid communication with the wellbore interior (FIG. 8). The pressurised fluid in chamber 108 induces piston 102 and wedge 96 to move in the direction of arrow 99 so as to move the segments 98 to the radially expanded position and thereby expanding the tubular element. After the expansion stroke, the three-way valve 112 is set to the second mode of operation whereby the fluid chamber 106 is in fluid communication with the fluid supply line 110. Since the piston 102 has a smaller hydraulic area at the side of chamber 108 than at the side of chamber 106, the piston 102 and wedge 96 move in the direction of arrow 100 so as to move the segments 98 to the radially retracted position. The fluid accumulator 114 absorbs pressure peaks in the hydraulic system that may occur when the valve setting is changed between the first mode and the second mode.

Normal use of the alternative hydraulic control system 116 of FIGS. 10, 11 is substantially similar to normal use of the hydraulic control system 94 of FIGS. 8, 9. To perform an expansion stroke, the four-way valve 116 is set to the first mode of operation whereby the pressurised fluid in fluid chamber 108 induces piston 102 and wedge 96 to move in the direction of arrow 99 so as to move the segments 98 to the radially expanded position and thereby expanding the tubular element. After the expansion stroke, the four-way valve 116 is set to the second mode of operation whereby the pressurised fluid in fluid chamber 106 induces piston 102 and wedge 96 to move in the direction of arrow 100 so as to move the segments 98 to the radially retracted position. Fluid accumulator 114 absorbs pressure peaks in the hydraulic system that may occur when the valve setting is changed between the first mode and the second mode.

We claim:

1. A method of radially expanding a tubular element in a wellbore using an expander located in the tubular element, the expander comprising:

an expansion member;

an anchor which is moveable between a radially retracted position wherein the anchor is free from an inner surface of the tubular element and a radially expanded position wherein the anchor engages the inner surface;

a suspension actuator which is connected to the expansion member and is operable to move the expansion member relative to the anchor; and a plurality of segments spaced in circumferential direction around the expansion member, the segments being movable between a radially refracted position and a radially expanded position by axial movement of the expansion member relative to the segments;

the method including a plurality of successive expansion cycles, wherein each expansion cycle comprises the steps of:

(a) moving the expander in axially forward direction through the tubular element whereby the segments are in the radially retracted position;

(b) operating the anchoring device so as to anchor the expander to the tubular element, and lowering the expander with the tubular suspended therefrom into the wellbore; and (c) radially expanding the tubular element by moving the segments to the radially expanded position by axially moving the expansion member relative to the segments.

2. The method of claim 1, comprising the steps of:

moving the anchor to the radially expanded position to engage the inner surface;

moving the anchor towards the expander until the segments are at least partially located in the tubular element.

3. The method of claim 1, wherein step (a) includes moving the expander towards the anchor.

4. The method of claim 1 wherein the segments and the expansion member have a wedge-shaped common contact surface so as to induce radially outward movement of the segment upon movement of the expansion member relative to the segment in a first axial direction, and to induce radially inward movement of the segment upon movement of the expansion member relative to the segments in a second axial direction opposite to the first axial direction.

5. The method of claim 1 wherein said movement of the segments to the radially expanded position defines an expansion stroke, each expansion stroke having a variable magnitude.

6. The method of claim 5, wherein the tubular element is radially expanded against a wall in the wellbore of varying diameter, and wherein the magnitude of the respective expansion strokes is varied in correspondence with said varying diameter of the wall.

7. The method of claim 5 wherein the expander comprises an actuator which is connected to the expansion member, wherein the magnitude of the expansion stroke is varied by varying the magnitude of actuator strokes of the actuator.

8. The method of claim 7, wherein the actuator is a hydraulic actuator which is in fluid communication with a hydraulic fluid supply conduit, and wherein the expander is suspended in the wellbore on the hydraulic fluid supply conduit.

9. The method of claim 8, wherein the hydraulic fluid supply conduit is selected from drill pipe and coiled tubing.

10. The method of claim 7 wherein the expansion member is subjected to alternating axial movement so as to alternatingly move the segments between the radially retracted position and the radially expanded position, and wherein the hydraulic actuator comprises a valve system operated to induce said alternating movement of the expansion member.

11. The method of claim 1 wherein said plurality of segments comprises first and second sets of segments, wherein the second set of segments is arranged in a following position relative to the first set of segments, whereby in the radially expanded position the second set of segments is of larger diameter than the first set of segments, and wherein in step (b) the tubular element is expanded to a first diameter by the first set of segments and to a second diameter by the second set of segments, the second diameter being larger than the first diameter.

12. A method of radially expanding a tubular element in a wellbore using an expander located in the tubular element, the expander comprising:

an expansion member;

an actuator which is connected to the expansion member, wherein the magnitude of the expansion stroke is varied by varying the magnitude of actuator strokes of the actuator; and a plurality of segments spaced in circumferential direction around the expansion member, the segments being movable between a radially refracted position and a radially expanded position by axial movement of the expansion member relative to the segments;

the method including a plurality of successive expansion cycles, wherein each expansion cycle comprises the steps of:

(a) moving the expander in axially forward direction through the tubular element whereby the segments are in the radially retracted position; and (b) radially expanding the tubular element by moving the segments to the radially expanded position by axially moving the expansion member relative to the segments wherein said movement of the segments to the radially expanded position defines an expansion stroke, each expansion stroke having a variable magnitude, and wherein the expansion member is subjected to alternating axial movement so as to alternatingly move the segments between the radially retracted position and the radially expanded position, and wherein the hydraulic actuator comprises a valve system operated to induce said alternating movement of the expansion member.

13. The method of claim 12, wherein the expander further comprises an anchoring device including:

an anchor which is moveable between a radially retracted position wherein the anchor is free from an inner surface of the tubular element and a radially expanded position wherein the anchor engages the inner surface; and a suspension actuator which is connected to the expansion member and is operable to move the expansion member relative to the anchor.

14. The method of claim 13, comprising the steps of:

moving the anchor to the radially expanded position to engage the inner surface;

moving the anchor towards the expander until the segments are at least partially located in the tubular element.

15. The method of claim 13 wherein step (a) includes moving the expander towards the anchor.

16. The method of claim 13, the method further comprising prior to step (b) the step of operating the anchoring device so as to anchor the expander to the tubular element, and lowering the expander with the tubular suspended therefrom into the wellbore.

17. The method of claim 12 wherein the segments and the expansion member have a wedge-shaped common contact surface so as to induce radially outward movement of the segment upon movement of the expansion member relative to the segment in a first axial direction, and to induce radially inward movement of the segment upon movement of the expansion member relative to the segments in a second axial direction opposite to the first axial direction.

18. The method of claim 12, wherein the tubular element is radially expanded against a wall in the wellbore of varying diameter, and wherein the magnitude of the respective expansion strokes is varied in correspondence with said varying diameter of the wall.

19. The method of claim 12, wherein the expander comprises an actuator which is connected to the expansion member, wherein the magnitude of the expansion stroke is varied by varying the magnitude of actuator strokes of the actuator.

20. The method of claim 12, wherein the actuator is a hydraulic actuator which is in fluid communication with a hydraulic fluid supply conduit, and wherein the expander is suspended in the wellbore on the hydraulic fluid supply conduit.

21. The method of claim 20, wherein the hydraulic fluid supply conduit is selected from drill pipe and coiled tubing.

22. The method of claim 12 wherein said plurality of segments comprises first and second sets of segments, wherein the second set of segments is arranged in a following position relative to the first set of segments, whereby in the radially expanded position the second set of segments is of larger diameter than the first set of segments, and wherein in step (b) the tubular element is expanded to a first diameter by the first set of segments and to a second diameter by the second set of segments, the second diameter being larger than the first diameter.

* * * * *